US006588161B2

(12) United States Patent
Smith

(10) Patent No.: US 6,588,161 B2
(45) Date of Patent: Jul. 8, 2003

(54) LAMINATED CONSTRUCTION ELEMENTS AND METHOD FOR CONSTRUCTING AN EARTHQUAKE-RESISTANT BUILDING

(76) Inventor: William Harry Smith, 3400 Smiley Rd., P.O. Box 1339, Cheminus, BC (CA), V0R 1K0

( * ) Notice: Subject to any disclaimer, the term of this patent is extended or adjusted under 35 U.S.C. 154(b) by 71 days.

(21) Appl. No.: 09/844,090

(22) Filed: Apr. 27, 2001

(65) Prior Publication Data

US 2002/0157334 A1 Oct. 31, 2002

(51) Int. Cl.[7] ..... E04B 1/10

(52) U.S. Cl. ..... 52/233; 52/223.7; 52/93.2; 52/794.1; 52/730.7; 52/747.1; 52/DIG. 8

(58) Field of Search ..... 52/233, 300, 286, 52/92.1, 92.2, 92.3, 93.1, 93.2, 794.1, 309.9, 309.14, 737.3, 730.7, 731.2, 745.06, 745.09, 747.1, DIG. 8, DIG. 9, 223.7

(56) References Cited

U.S. PATENT DOCUMENTS 3,473,277 A * 10/1969 Straight ..... 52/233
3,979,862 A * 9/1976 Hamilton et al. ..... 52/233
4,147,000 A 4/1979 Lewandowski
4,277,925 A 7/1981 Kinser
4,391,067 A 7/1983 Frady et al.
4,463,532 A 8/1984 Faw
4,823,528 A * 4/1989 Faw ..... 52/233
5,026,593 A * 6/1991 O'Brien ..... 428/215
5,265,390 A * 11/1993 Tanner ..... 52/233
RE35,327 E * 9/1996 Sing ..... 52/309.9
5,600,923 A 2/1997 Riley
5,865,929 A * 2/1999 Sing ..... 156/264
6,279,293 B1 * 8/2001 Ojala ..... 52/794.1

* cited by examiner

*Primary Examiner*—Carl D. Friedman
*Assistant Examiner*—Naoko Slack
(74) *Attorney, Agent, or Firm*—Olson & Hierl, Ltd.

(57) ABSTRACT

Laminated interlocking stackable wall units are assembled using a large proportion of wood species unsuitable for use in the construction industry. The interlocking stackable wall units are used in combination with a laminated roof beam, and a roof panel to construct an earthquake-resistant buildings. Each building is tied together by composite steel bands that lend the structure flexibility and excellent resistance to wracking forces induced by natural phenomena, such as earthquakes and windstorms. The buildings are rapidly assembled with a minimum of labor, and are inexpensive to construct. The advantage is a high quality building constructed at reasonable cost.

25 Claims, 7 Drawing Sheets

LAMINATED CONSTRUCTION ELEMENTS AND METHOD FOR CONSTRUCTING AN EARTHQUAKE-RESISTANT BUILDING

CROSS-REFERENCE TO RELATED APPLICATIONS

This is the first application filed for the present invention.

MICROFICHE APPENDIX

Not Applicable.

TECHNICAL FIELD

This invention relates in general to construction elements for assembling buildings and, in particular, to construction elements for assembling an earthquake-resistant building using an interlocking, stackable wall unit and a laminated roof beam.

BACKGROUND OF THE INVENTION

There is a continuing need in the building industry for well-constructed buildings that are resistant to natural forces, such as earthquakes and windstorms. At the same time, it is well recognized that quality building materials are increasingly in short supply. Even though quality building materials are in short supply, building codes continually impose stricter standards respecting structural integrity. There is also a strong demand for quality construction that is aesthetically pleasing and affordably priced.

It has been long recognized that log constructions have a broad aesthetic appeal. There have, therefore, been many patents issued for various types of log or simulated-log constructions. Most of these constructions, however, require top quality raw materials. Therefore, a problem with most such constructions is the unavailability or cost of quality raw materials and/or the amount of skilled labour required to assemble them. Furthermore, most simulated log structures are no better than frame constructions at resisting the forces of nature.

There therefore exists a need for building elements constructed, at least in part, from low quality materials that are generally otherwise unusable in the construction industry. There also exists a need for low cost building elements that may be used to construct a building that is resistant to earthquake and windstorm.

SUMMARY OF THE INVENTION

It is, therefore, an object of the invention to provide quality, low-cost construction elements for assembling an earthquake-resistant building.

It is a further object of the invention to provide a method of constructing an earthquake-resistant building using building elements assembled, at least in part, from lumber species which are generally unsuitable for use in the construction industry.

The invention, therefore, provides construction elements for assembling an earthquake-resistant building. The construction elements comprise an interlocking, stackable wall unit comprising a load bearing interior laminate, a load bearing exterior laminate and a rigid insulating core bonded between the respective interior and exterior laminates. The building elements further comprise a laminated roof beam. The laminated roof beam includes opposed outer load bearing members having a predetermined width, an inner load bearing member and an elongated metal plate that is laminated together with the load bearing members to form the laminated roof beam. The metal plate is sandwiched between one of the outer load bearing members and the inner load bearing member in order to provide aesthetic appeal. In accordance with a preferred embodiment, the inner load bearing member is not as wide as the outer load bearing members in order to provide a channel between the outer load bearing members that accepts wiring, plumbing or the like.

The invention further provides a method of constructing an earthquake-resistant building. In accordance with the method, a plurality of steel rods of an appropriate length are connected in a vertical orientation to a foundation for the building. The steel rods are spaced apart a predetermined distance and have respectively threaded top ends. Walls of the building are erected by stacking the stackable wall units 10 described above. The stackable wall units 10 are predrilled to accept the spaced-apart, vertical rods so that the vertical rods pass through the insulating core of each stackable wall unit. After the walls are stacked to a desired height, a wall plate is placed over the top of the walls. A ridge pole is then erected to support center ends of laminated roof beams for the building. A roof frame is erected by mounting opposed pairs of the laminated roof beams, constructed as described above. The laminated roof beams are supported in the center by the ridge pole and, on the outer ends, by the side wall plates. The outer ends of the roof beams are positioned adjacent respective ones of the steel rods that extend from the foundation upwardly through the side walls. The roof beams are joined above the ridge pole using steel brackets bolted to the respective beams, and are joined to the wall using steel brackets that are adapted to be received on the respective threaded rods, and bolted to the beam. After the brackets are positioned, washers and nuts are secured to the tops of the threaded rods to tie the foundation, walls and roof together. The steel rods, in combination with the brackets and the metal plates laminated into the roof beams, provide a continuous flexible connection between the foundation, the side walls and the roof, which is extremely resistant to wracking forces induced by earthquakes and/or windstorms.

The building in accordance with the invention provides a simulated log structure with exceptional weather resistance, wrack resistance and aesthetic appeal. Because the interlocking stackable wall units 10 are assembled using a significant percentage of waste wood, the cost of the building is controlled, and lumber resources are conserved.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

The invention provides building elements used to assemble an earthquake-resistant building suitable as a domestic dwelling, or the like.

Figure 1:
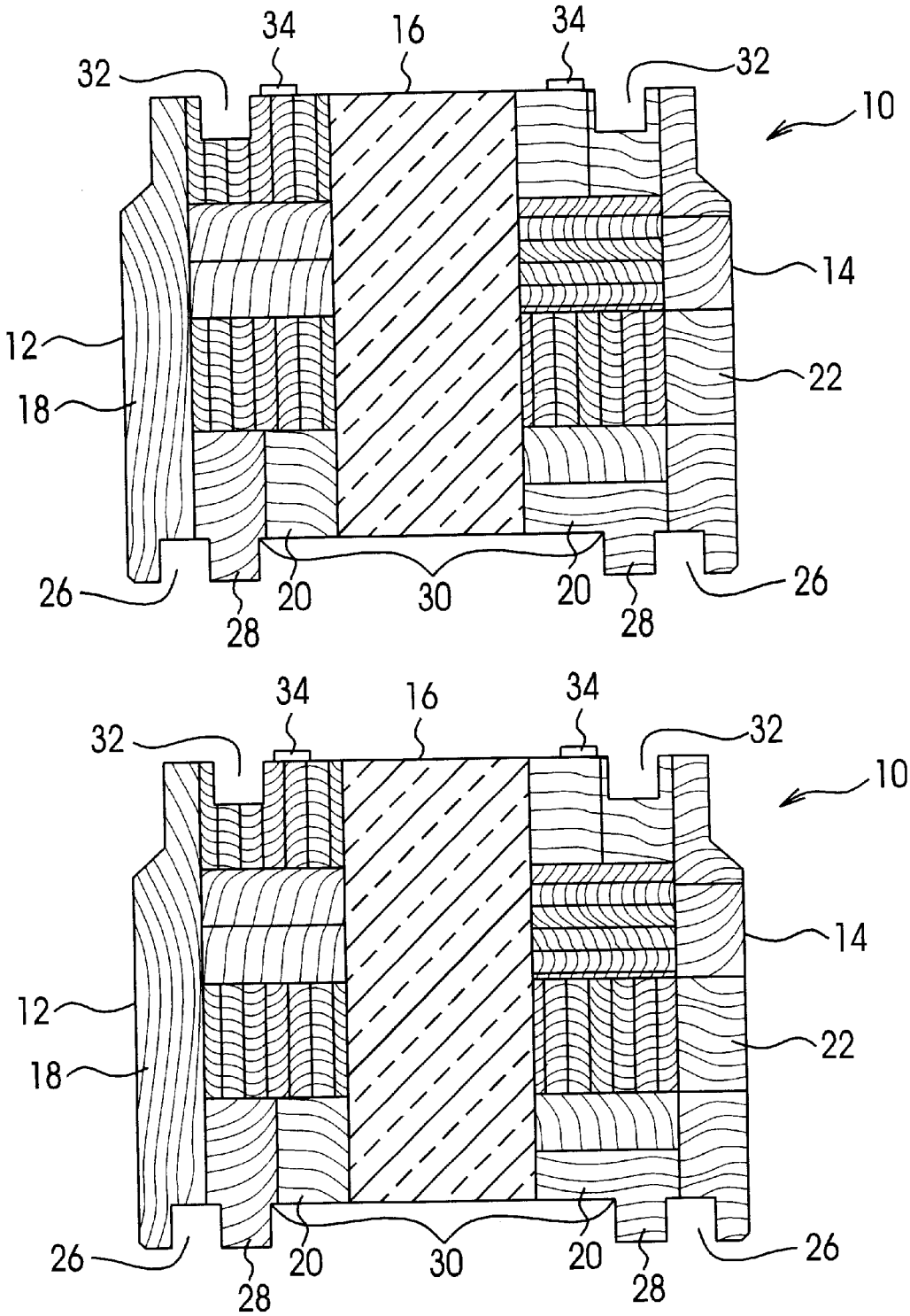
FIG. 1. is a cross-sectional view of the stackable wall unit in accordance with a preferred embodiment of the invention.
Figure 12:
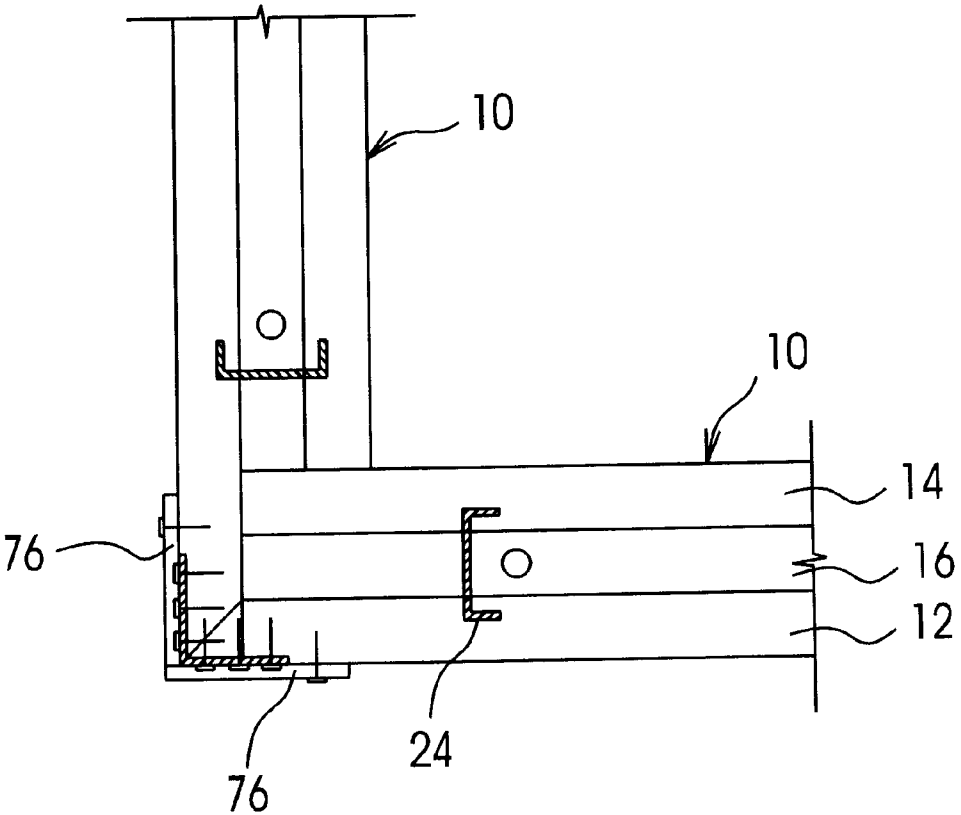
FIG. 12 is a cross-sectional view of the corner detail shown in FIG. 11.

FIG. 1 is a cross-sectional view of an interlocking, stackable wall unit 10. The stackable wall unit 10 includes an outer laminate 12, an inner laminate 14 and a core 16 of a rigid insulation material (a rigid polyurethane foam, for example). The outer laminate 12 includes an outer layer 18 which is preferably a solid wood layer that extends a full length of the stackable wall unit 10 (typically 14'), The outer layer 18 is, for example, a western red cedar plank that is ⅝" thick. The outer layer 18 is preferably a solid wood for improved weather-resistance and aesthetic appeal. The outer laminate 12 further includes an inner layer 20 which is a glue laminated composite that may be built-up using any species of any length, any width or thickness. The inner layer 20 is edge laminated using finger jointed strips, then re-sawn to size. The inner laminate is glued, for example, using a polyvinyl acetate glue (PVA-150). The wood used is preferably wood that may be unprocessable in the industry or unsuitable for use in the construction industry. The inner laminate 14 includes an interior finish 22 which is bonded to an inner layer 20 described above. The interior finish 22 may be a solid wood layer or a glue laminated layer which is finger jointed and edge glued. Both the inner and outer surfaces of the stackable wall unit 10 are factory finished with a wood sealer and a suitable wood finish, such as a water-based urethane composition which is well known in the art. The outer laminate 12 and the inner laminate 14 are respectively glued to the rigid insulation core 16. Besides the glue lamination to the rigid insulation core 16, the inner and outer laminates are interconnected by C-shaped steel reinforcement members 24 which are driven about 1" into a top surface of each stackable wall unit 10 at a predetermined interval, such as 4' on center, for example, as shown in FIG. 12.

A bottom surface of each stackable wall unit 10 includes a pair of longitudinally extending grooves 26, which extend along a length of each unit 10. The grooves 26 are flanked by longitudinal tongues 28, which likewise extend along the length of each unit. A broad groove 30 is located between the respective tongues 28. A top surface of each stackable wall unit 10 includes elongated grooves 32. The top grooves 32 receive the tongues 28 of a next stackable wall unit 10 as the wall in assembled. As each layer of a wall is assembled, a weather seal 34 is applied beside each top groove 32 to inhibit the infiltration of air through the wall construction. The weather seal 34 is preferably a foam tape, such as a polyurethane foam tape. Other weather seals may alternatively be used, such as a butyl caulk, or the like.

Figure 2:
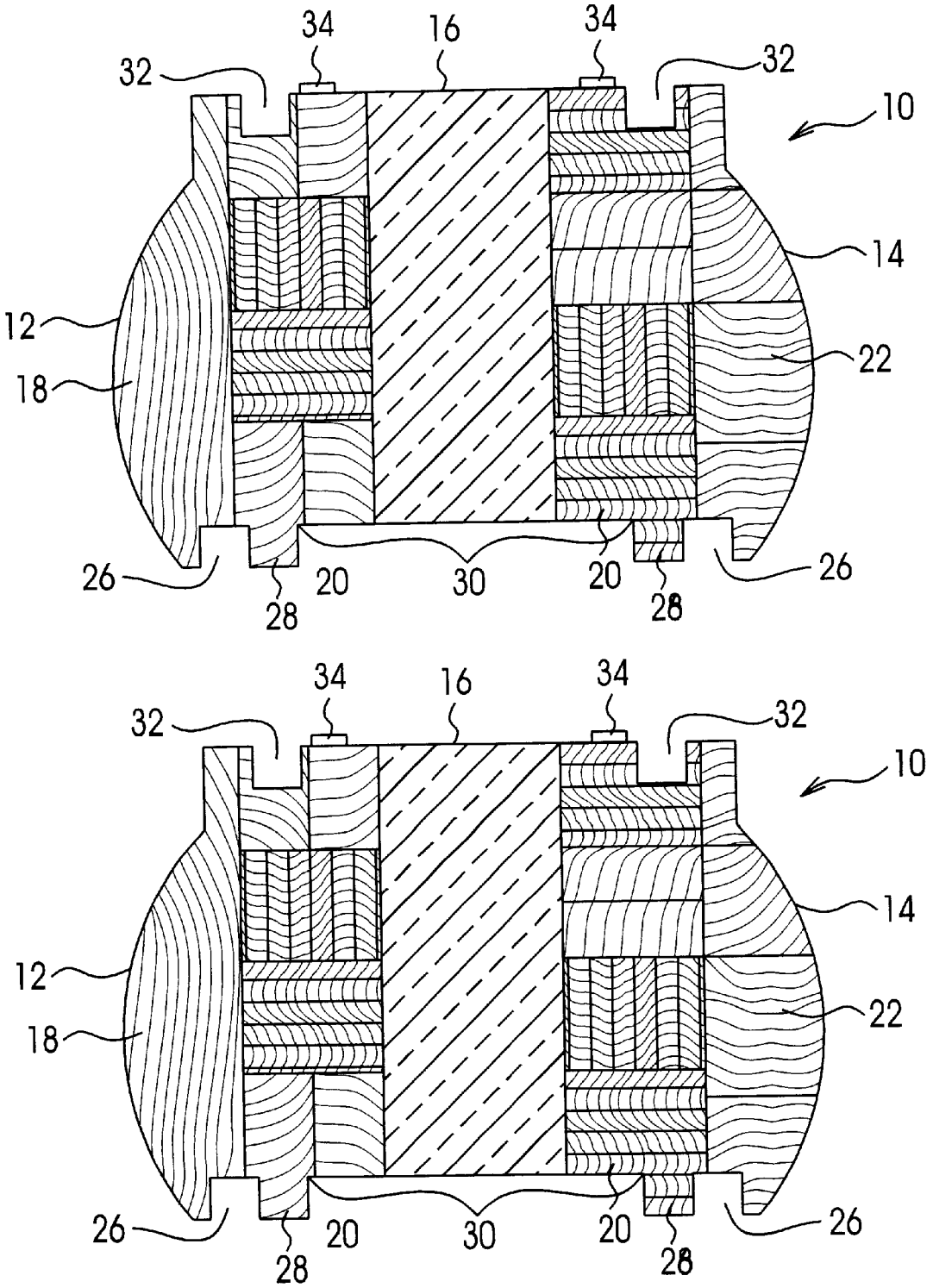
FIG. 2 is a cross-sectional view of an alternate embodiment of the stackable wall unit shown in FIG. 1.

FIG. 2 shows a cross-sectional detail of an alternate configuration of the stackable wall unit 10 in accordance with the invention. The stackable wall unit 10 shown in FIG. 2 is identical to that shown in FIG. 1 with the exception that the outer layer 18 and the interior finish 22 are shaped to simulate round logs rather than the squared logs simulated by the stackable wall unit shown in FIG. 1.

Figure 3:
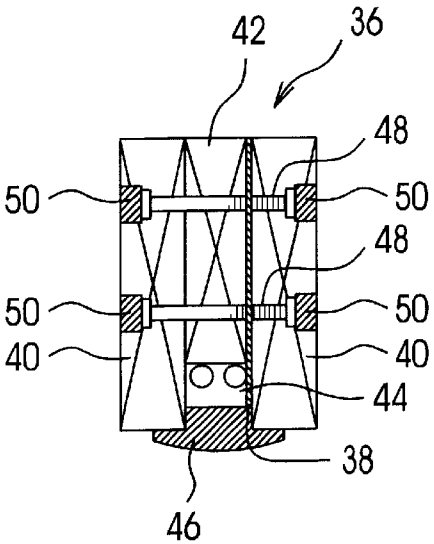
FIG. 3 is a cross-sectional view of a roof beam in accordance with a preferred embodiment of the invention.

FIG. 3 is a cross-sectional view of a preferred construction for a roof beam 36 in accordance with the invention. The roof beam 36 is a laminated structure for which materials are selected in accordance with the requirements of a particular building. In a typical structure, the roof beam 36 is a three-ply laminated beam constructed of 2×6, 2×8, 2×10, or 2×12 lumber, laminated together with a steel reinforcing plate 38, preferably a 20 gauge steel sheet bonded between two of the three laminate members. Laminated beam 36 includes first and second outer load bearing members 40 and an inner load bearing member 42. The inner load bearing member 42 preferably has a width that is less than the width of the outer load bearing members 40 to form a conduit recess 44 which may be used to run electrical wires, or the like. The conduit recess 44 is covered by a conduit recess cap 46, typically a shaped wood cap that is stapled or nailed to the outer load bearing members 40 after wiring or plumbing has been installed. The roof beam 36 is laminated using steel bolts 48, such as ⅜" carriage bolts located in pairs spaced 24" on center. Each end of each bolt 48 is preferably concealed using a wood filler plug 50. The connection of the roof beam 36 to the building structure will be explained below in detail with reference to FIG. 13.

Figure 5:
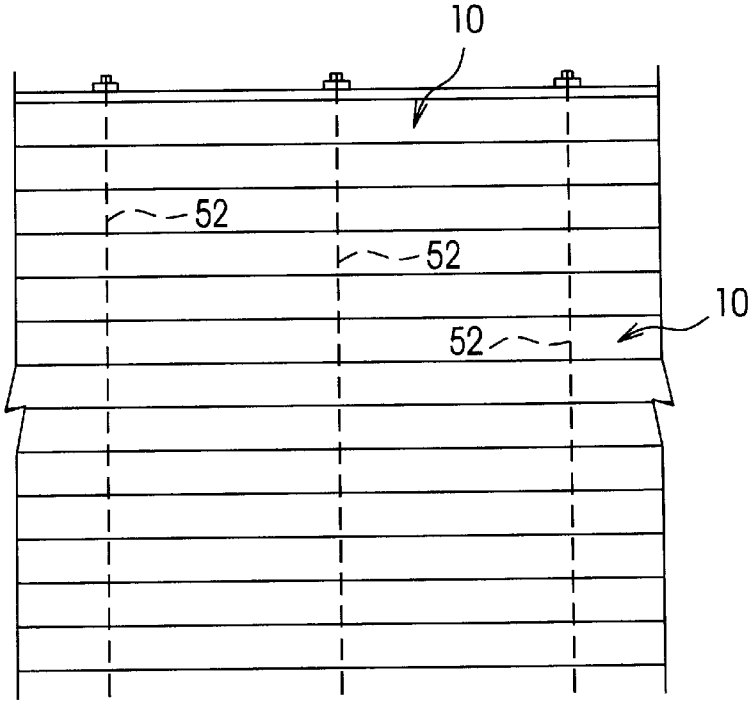
FIG. 5 is a side elevational view of the wall shown in FIG. 4.
Figure 4:
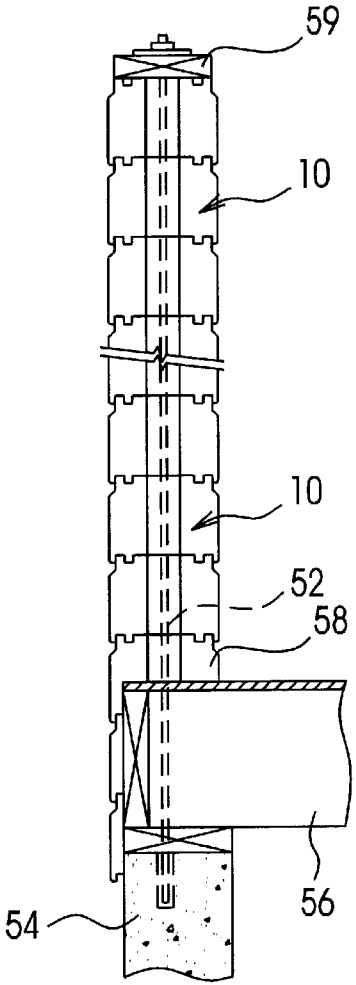
FIG. 4 is a cross-sectional view of an assembled wall of a building constructed in accordance with the invention.

FIG. 4 is a cross-sectional view of an assembled wall or building structure in accordance with the invention. Assembly of the building structure commences by connecting a plurality of steel rods 52 to a concrete foundation for the building. The steel rods 52 may be set into the concrete foundation before the foundation is poured, or installed afterwards using methods well known in the art. A floor 56 is constructed on the foundation in a manner well known in the art. Thereafter, a wall structure in accordance with the invention is constructed by stacking successive rows of the stackable wall units 10 on the vertically oriented steel rods 52. The stackable wall units 10 are pre-drilled to accept the vertically-oriented steel rods 52. The vertically-oriented steel rods are preferably located at 4' on center around a perimeter of the building. Successive courses of the stackable wall units 10 are assembled until the wall is completed, as shown in FIG. 5. To commence the wall, a solid wood starter member 58 is nailed to the floor 56 and the stackable wall units 10 are stacked one on top of the other as described above while placing the weather seals 34 between each course, as described above with reference to FIG. 1. To complete the wall, a pre-drilled top plate 59, a 2"×8", for example, is mounted to the top course of the wall and nailed to the respective inner and outer laminates 12, 14 (FIGS. 1 and 2) of the top course.

Figure 6:
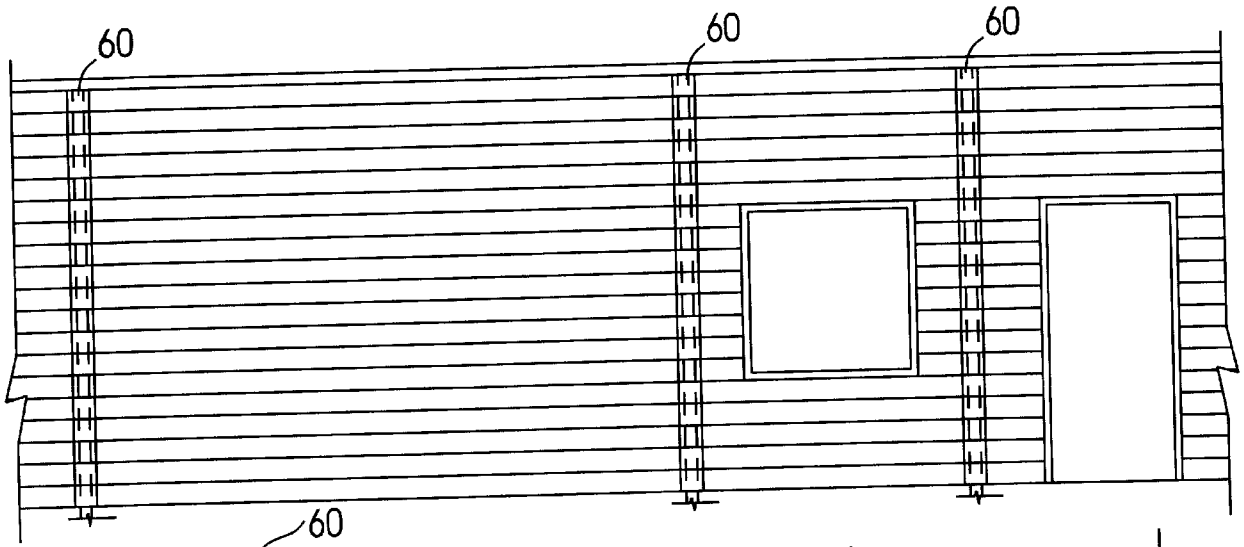
FIG. 6 is an elevational view of a wall structure showing vertical wall reinforcement details.
Figure 7:
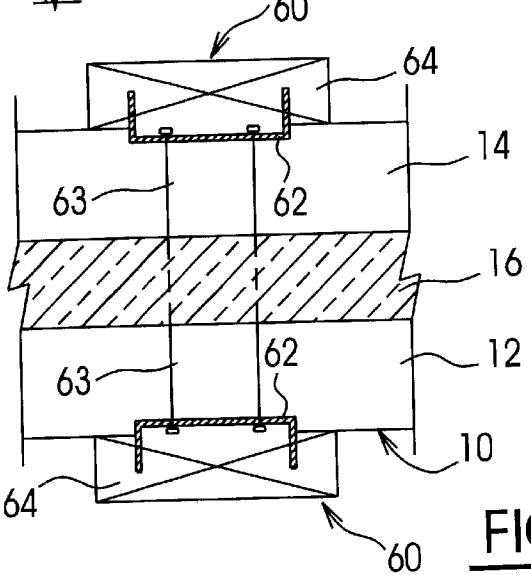
FIG. 7 is a cross-sectional view of the vertical wall reinforcements shown in FIG. 6.

FIG. 6 shows the application of wall reinforcement members 60 which are preferably aesthetically positioned around door and window openings, and may be positioned for aesthetic or structural reasons at other locations on a finished wall. The reinforcement members 60 are shown in cross-sectional view in FIG. 7. Each reinforcement member includes a 3½" metal stud 62, preferably constructed of 20 gauge steel, positioned on each side of the wall and notched ⅜" into the stackable wall units 10. A bottom end of the metal studs is connected to the concrete foundation wall using, for example, 2⅜" lag bolts (not shown). Each metal stud 62 is covered by a wood plate 64, such as a 2"×6" of red cedar, or the like, having parallel grooves for receiving the flanges of the metal studs 62. The metal studs 62 are installed in wide grooves cut ⅜" deep in the respective inner and outer surfaces of the stackable wall units 10, and secured thereto using common nails 63, for example. Wood plates 64 may be glued, screwed, or nailed to the wall structure.

Figure 8:
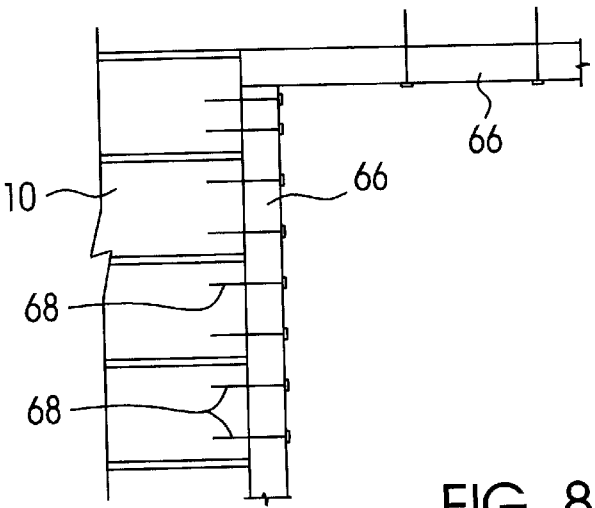
FIG. 8 is a detailed view of rough opening framing in accordance with the invention for doors and windows.

FIG. 8 is a detailed view of the finish for rough openings for doors and windows in a building construction in accordance with the invention. Each door and window opening is framed by solid wood framing members 66, 2"×8", for example, which are preferably secured to the stackable wall units 10 using, for example, common nails 68.

Figure 10:
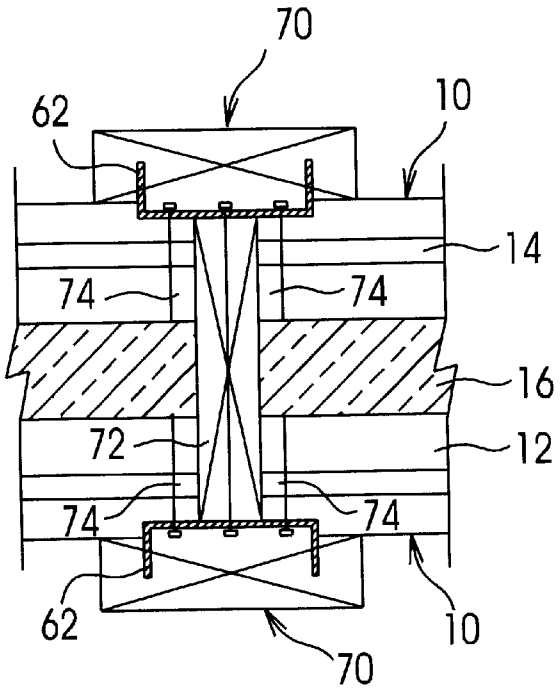
FIG. 10 is a cross-sectional view of the joint shown in FIG. 9.
Figure 9:
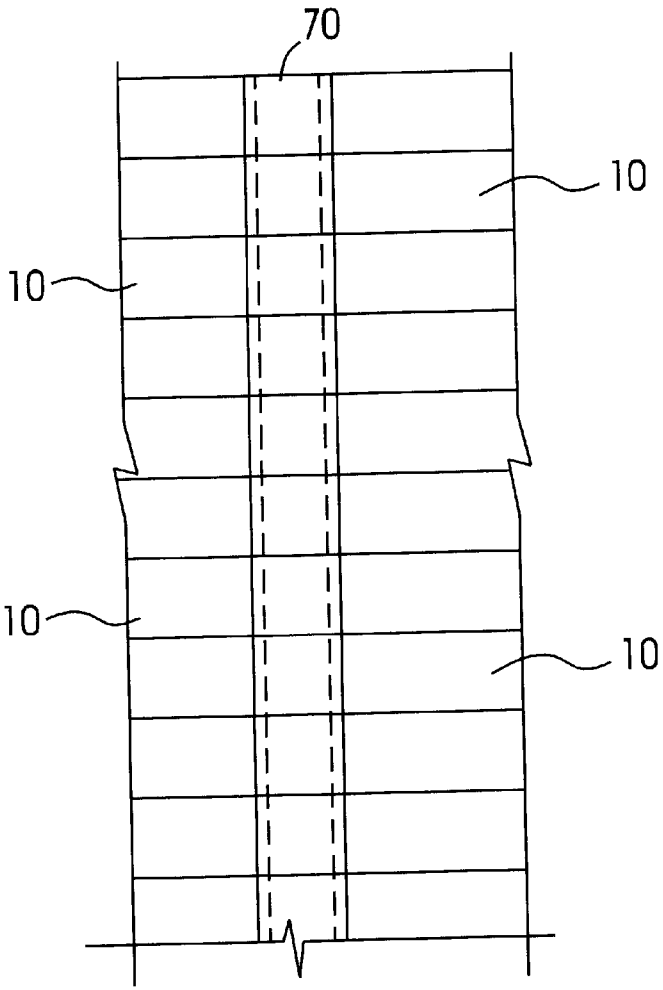
FIG. 9 is an elevational view of a joint detail for the stackable wall unit in accordance with the invention.

The stackable wall units 10 in accordance with the invention are conveniently about 14' long. FIG. 9 shows an elevational view of a joint detail for joining the stackable wall units 10. The joint 70 is similar to the wall reinforcement member 60 described above. FIG. 10 shows a cross-sectional view of the joint 70 used to butt join two courses of stackable wall units 10. The joint 70 includes a transverse joint member 72, typically 2"×8" lumber, though laminated material may likewise be used. The transverse joint member and opposite ends of the stackable wall units 10 are covered by 3½" 20 gauge metal studs 62 notched ⅜" into the stackable wall units 10 and connected to each of the stackable wall units 10 and the transverse joint member 72 by, for example, 3" common nails 74 at 4" on center.

Figure 11:
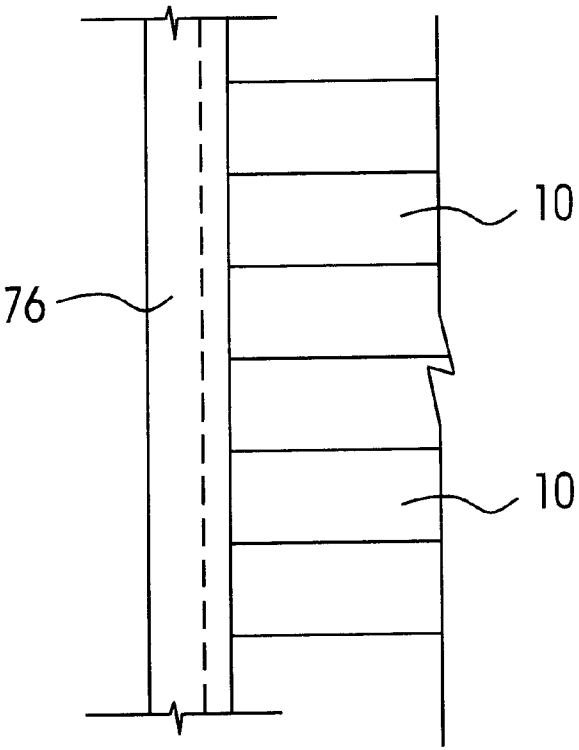
FIG. 11 is an elevational view of a building corner constructed in accordance with the invention.

FIG. 11 shows a preferred corner detail for a building constructed using the stackable wall units 10 in accordance with the invention. Corners are preferably trimmed with trim boards 76 which are, for example, 1¾"×6" western red cedar corner trim boards nailed to the stackable wall units 10 as shown in FIG. 12, which illustrates a cross-sectional view of the corner construction. Underlying the trim boards 76 is a galvanized steel angle 78 that is, for example, 20 gauge steel and preferably about 4"×4" notched ⅜" into the respective stackable wall units 10. The steel angle 78 is preferably fastened with 2" common nails at 4" on center. The steel angle 78 preferably extends 6" below a top of the foundation (not shown), and is secured to the concrete with two, 2"×½" lag bolts.

Figure 13:
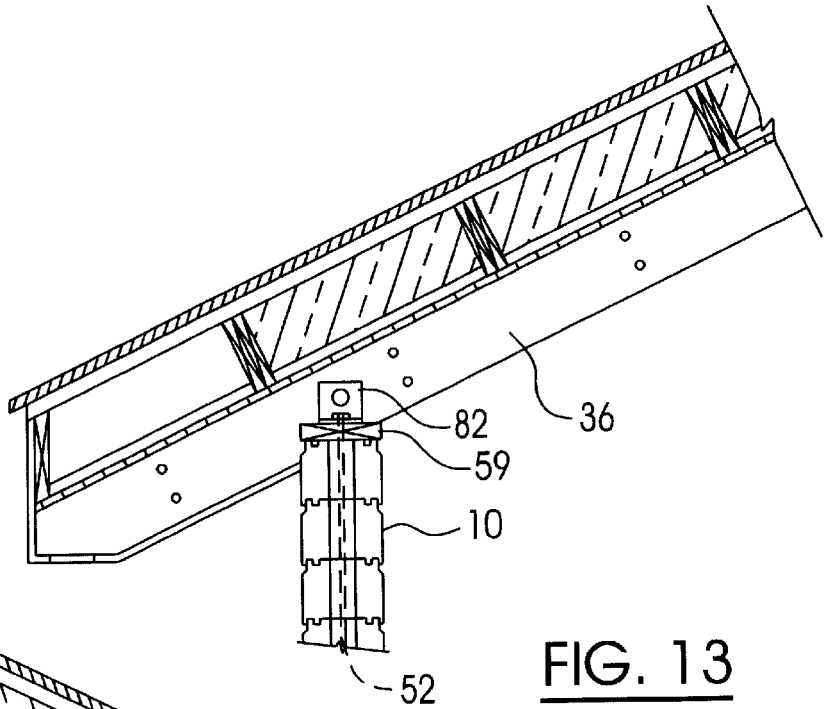
FIG. 13 is a cross-sectional view of a roof construction in accordance with the invention, showing the connection of a roof beam to the wall structure.

FIG. 13 is a cross-sectional view of a finished wall constructed using stackable wall units 10, with a roof structure using the roof beam 36 in accordance with the invention.

Figure 14:
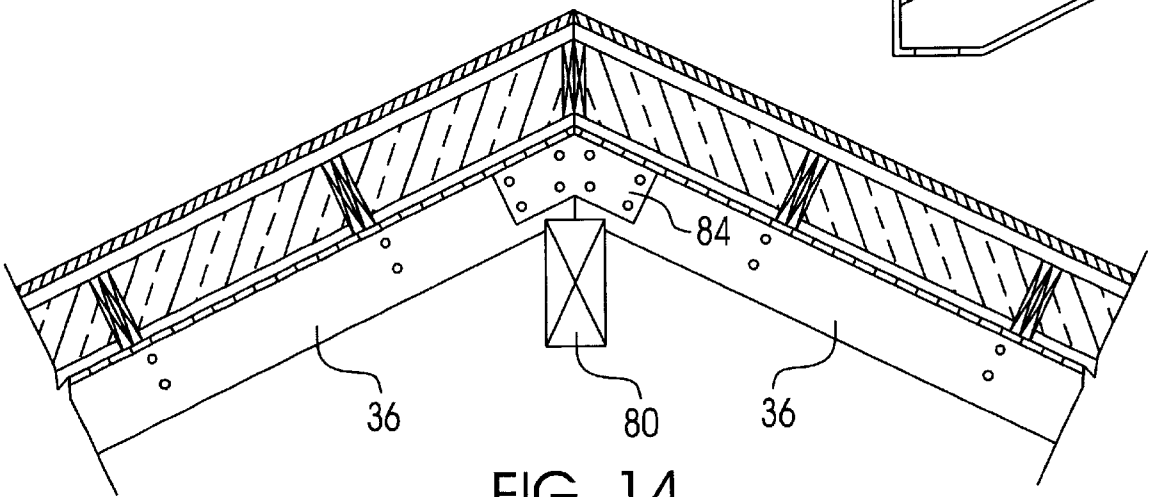
FIG. 14 is a cross-sectional view of the roof construction showing finishing details at the roof ridge.

FIG. 14 is a cross-sectional view of the roof structure illustrating a roof ridge detail. The roof is constructed by erecting a ridge beam 80 after the gable walls (now shown) are assembled, using the stackable wall units 10, for example. Thereafter, opposed pairs of roof beams 36 are positioned at 4' on center, adjacent the respective steel rods 52 which extend from the foundation up through the side walls assembled using stackable wall units 10, as explained above. The respective laminated roof beams 36 are connected to the steel rods 52 using an L-shaped bracket 82 (FIG. 13) which connects on one end to the steel rod 52 and on the opposite end to the roof beam 36 using, for example, a ½" carriage bolt inserted through the bracket 82 and a transverse bore drilled through the roof beam 36.

As shown in FIG. 14, the opposed roof beams 36 are connected together using 20 gauge steel plates 84 bolted to each side of the laminated roof beam 36 using ⅜" carriage bolts. The brackets are installed by boring holes through the laminated roof beams in alignment with complementary holes in brackets on opposite sides of the roof beams, and inserting the carriage bolts through the holes. Consequently, due to the steel reinforcing plate 38 in each roof beam 36, described above with reference to FIG. 3, once the roof beams 36 are installed, the entire house structure is connected to the concrete foundation by substantially continuous steel ribs spaced at 4' on center. Due to the tensile strength combined with the flexibility of the steel ribs, the structure is able to withstand significant bending and racking forces exerted by natural forces, such as earthquakes or windstorms.

Figure 15:
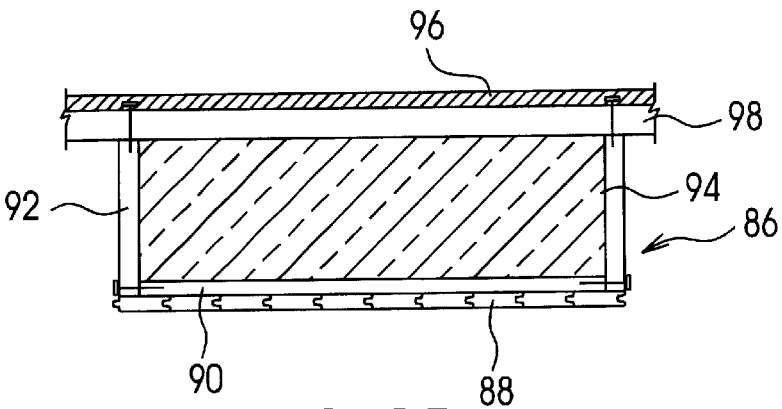
FIG. 15 is a cross-sectional view of a roof panel in accordance with the invention.

The roof is constructed using pre-assembled roofing panels 86 shown in FIG. 15. Each pre-assembled roofing panel includes a pre-finished interior surface 88 which is, for example, a tongue-and-groove wood finish, well known in the art. The opposite side edges of the roof panels are complementary so that, when two adjacent panels 86 are installed atop the roof beams, a continuous finished interior ceiling for the building is formed. The interior surface 88 is connected to 1"×2" spacers 90 nailed between 1"×8" panel sides 92, that surround insulating material 94, for example, 7" thick rigid foam insulation. To construct a roof, the roof panels 86 are laid over the roof beams 36 as shown in FIGS. 13 and 14, preferably starting from a bottom of the roof and working upwardly. Each panel 86 is nailed or screwed to the respective roof beams 36 in a manner well known in the art. The panel sides 92 of two adjacent panels form, in combination, a 2"×8" to which roofing sheathing 96 may be directly secured. Alternatively, strapping 98, such as 2"×4" strapping at 24" on center, may be nailed to the panel sides 92 to provide ventilation space above the insulating material 94. Thereafter, a suitable roofing finish is applied in a manner well known in the art.

The invention therefore provides a solid, well insulated building structure which is very resistant to wracking forces resulting from natural phenomena, such as earthquake and windstorm. The building structure is rapidly assembled, and the stackable wall units 10 are constructed using a significant proportion of materials generally unsuited for use in the construction industry, so labour and material costs are controlled.

The embodiment(s) of the invention described above is(are) intended to be exemplary only. The scope of the invention is therefore intended to be limited solely by the scope of the appended claims.

I claim:

1. Construction elements for assembling an earthquake-resistant building, comprising in combination:

an interlocking, stackable wall unit comprising a load bearing inner laminate, a load bearing outer laminate and a rigid insulating core bonded between the respective inner and outer laminates and the inner and outer laminates respectively include a top surface with a parallel-sided longitudinal groove and a bottom surface with a complimentary tongue that is received in the groove when one of the stackable wall units is stacked on top of another;

a laminated roof beam comprising opposed outer load bearing members having a predetermined length and width, an inner load bearing member having the same predetermined length and at most the predetermined width, and an elongated metal plate having the predetermined length and at most the predetermined width, the respective outer load bearing members, inner load bearing member and metal plate being laminated together so that the metal plate is between one of the outer load bearing members and the inner load bearing member; and steel rods adapted to be anchored in a foundation of the building and to extend vertically through the stackable wall units stacked on top of one another to form an exterior wall of the building, and through brackets connected to outer ends of the laminated roof beams to tie the foundation, exterior walls and roof beams for resisting wracking forces.

2. Construction elements as claimed in claim 1 wherein the inner laminate and the outer laminate are constructed using a significant percentage of wood that is generally unsuitable for use in the construction industry.

3. Construction elements as claimed in claim 2 wherein inner layers of the inner laminate and the outer laminate are assembled using finger joints to join pieces together at their ends, and edge lamination to build up beams that are re-sawn to a required shape.

4. Construction elements as claimed in claim 2 wherein an outer surface of the outer laminate is a solid wood plank that extends a length and width of the stackable wall unit.

5. Construction elements as claimed in claim 1 wherein the inner load bearing member of the roof beam is narrower than the outer load bearing members, to form a channel in an inner side of the roof beam, the channel serving as a conduit recess to permit wiring to be run along the roof beam.

6. Construction elements as claimed in claim 5 further comprising a conduit recess cover adapted to cover the conduit recess after the wiring has been run.

7. Construction elements as claimed in claim 1 wherein the roof beam is laminated using bolts inserted through bores drilled through the outer load bearing members, the inner load bearing member and the elongated metal plate.

8. Construction elements as claimed in claim 1 further comprising a roof panel, that is laid over the roof beams to construct a roof, the roof panel including;

a finished inner surface having respective longitudinal edges that mate with corresponding edges of adjacent roof panels, the finished inner surface being connected to spacers that interconnect panel sides, the panel sides surrounding insulating material for insulating the roof.

9. Construction elements as claimed in claim 8 wherein the finished inner surface is a tongue-and-groove finish made of wood.

10. Construction elements as claimed in claim 1 further comprising C-shaped reinforcement members which are driven into a top surface of each stackable wall unit to tie together the inner and outer laminates.

11. Construction elements as claimed in claim 1 further comprising wall reinforcement members comprising a vertically oriented metal stud positioned in each side of the wall and secured thereto, and a wood plate that covers each of the metal studs.

12. Construction elements as claimed in claim 1 further comprising a corner reinforcing angle adapted to the secure to corners of the building, and trim boards that are applied to the corners of the building to conceal the corner reinforcing angles.

13. A method of constructing an earthquake-resistant building, comprising:

a) connecting in a vertical orientation to a foundation for the building, a plurality of steel rods, the steel rods being spaced apart a predetermined distance and having respective threaded top ends;

b) erecting walls for the building by stacking over the steel rods predrilled, stackable wall units comprising a load bearing inner laminate, a load bearing outer laminate and a rigid insulating core bonded between the respective inner and outer laminates;

c) securing a wall plate to a top of the erected walls;

d) erecting a ridge beam to support center ends of opposed pairs of roof beams for supporting a roof for the building;

d) mounting the opposed pairs of roof beams to the ridge beam and opposed side wall plates, adjacent a top end of each of the steel rods that extend through the opposed side wall plates, each roof beam comprising opposed outer load bearing members having a predetermined length and a predetermined width, an inner load bearing member having the predetermined length and at most the predetermined width, and a metal plate having the predetermined length and at most the predetermined width, the respective outer members, inner members and the metal plate being laminated together so that the metal plate is between one of the outer members and the inner member; and e) installing brackets to tie the respective roof beams to the respective steel rods, and to tie together ends of the roof beams where they meet above the ridge beam; and f) installing nuts on the top ends of the vertical steel rods to secure the walls and the roof beams to the foundation.

14. The method as claimed in claim 13 wherein the step of erecting walls comprises a first step of commencing the wall with a solid wood starter member having a top surface that is complementary with a bottom surface of the stackable wall units.

15. The method as claimed in claim 13 wherein the step of erecting walls further comprises a step of placing a weather seal on a top surface of each stackable wall unit before a next stackable wall unit is added to the wall, to provide a weather-tight seal between the stackable wall units.

16. The method as claimed in claim 13 wherein the step of placing a weather seal comprises a step of adhering a foam tape along and inner edge of a longitudinal groove in a top surface of each on the inner and outer laminates of the stackable wall units.

17. The method as claimed in claim 13 wherein the step of securing a wall plate to a top of the erected walls comprises a step of securing a solid wood plate to a top of the erected walls.

18. The method as claimed in claim 13 wherein the step of installing the brackets to tie the roof beams to the respective steel rods comprises a step of installing an L-shaped bracket on each of the respective steel rods adjacent a roof beam, drilling a hole through the roof beam in alignment with a complementary hole in the L-shaped bracket, and inserting a bolt through the L-shaped bracket and the roof beam to tie the roof beam to the steel rod.

19. The method as claimed in claim 13 wherein the step of installing the brackets to tie together the roof beams where they meet over the ridge pole comprises a step of boring holes through the laminated roof beams in alignment with complimentary holes in brackets on opposite sides of the roof beams, and inserting bolts through the respective holes.

20. The method as claimed in claim 13 further comprising a step of mounting roof panels on the roof beams to provide a roof for the building.

21. The method as claimed in claim 20 comprising a step of installing a first panel at a bottom edge of the roof beams, and building the roof towards the peak by adding respective subsequent panels.

22. The method as claimed in claim 21 further comprising installing sheathing to a top of the roof panels.

23. The method as claimed in claim 22 further comprising a step of installing strapping at right angles to the panels prior to applying the roof sheathing and applying the sheathing to the strapping.

24. The method as claimed in claim 13 further comprising a step of after stacking each one of the stackable wall units, driving at least one C-shaped reinforcement member into a top surface of the stackable wall units to tie together the inner and outer load bearing laminants.

25. The method as claimed in claim 13 further comprising a step of applying to walls constructed using the stackable wall units at least one wall reinforcement member by forming a vertical notch in each side of the constructed wall, placing a metal stud in the respective notches, securing the studs to the stackable wall units, and securing a wood plate to the constructed wall to conceal the metal studs.

* * * * *